United States Patent [19]

Rousseau

[11] 4,073,107

[45] Feb. 14, 1978

[54] CURTAIN WALL STRUCTURE

[75] Inventor: Paul E. Rousseau, Uccle, Belgium

[73] Assignee: "Applications de la Chimle, de l'Electricite et des Metaux" en abrege:"SADACEM", Brussels, Belgium

[21] Appl. No.: 775,545

[22] Filed: Mar. 8, 1977

[30] Foreign Application Priority Data

Mar. 8, 1976 Belgium ..... 839314

[51] Int. Cl.[2] ..... E04H 1/00

[52] U.S. Cl. ..... 52/235; 52/167; 52/403

[58] Field of Search ..... 52/167, 235, 403

[56] References Cited

U.S. PATENT DOCUMENTS

| | | | |
|---|---|---|---|
| 440,938 | 11/1890 | Anthoni | 52/167 |
| 3,994,107 | 11/1976 | Anghuet | 52/235 |

FOREIGN PATENT DOCUMENTS

| | | | |
|---|---|---|---|
| 2,327,055 | 12/1974 | Germany | 52/167 |
| 431,487 | 6/1926 | Germany | 52/513 |
| 1,139,626 | 11/1962 | Germany | 52/235 |

*Primary Examiner*—Alfred C. Perham
*Attorney, Agent, or Firm*—Scully, Scott, Murphy & Presser

[57] ABSTRACT

There is described a curtain wall structure comprising a metal frame provided with a compensation bar for bearing on or hanging from a projecting element fastened to the building skeleton, each metal frame also comprising members for taking over the forces due to the wind, in which said projecting element is provided with resilient means on which said compensation bar bears.

6 Claims, 6 Drawing Figures

CURTAIN WALL STRUCTURE

The invention has for object to provide improvements allowing the building of so-called "anti-sismic" frontages or curtain-walls, that is curtain walls which can withstand without damage either earth tremors or strong vibrations caused either by explosions or by the passage of planes through the sound barrier.

The swinging or vibrating motions of building skeletons bearing the fastenings of curtain walls were up to now integrally transferred to the frontage elements. The accelerations when a building vibrates, can be very strong and cause in the hanging device of these elements forming the curtain wall, both in the frames and in the glazing thereof, very damaging destructive stresses.

Conversely, the vibrations induced in the frontage elements by strong noises or explosions were transferred to the bearing elements fastened to the building skeleton.

The invention has more particularly for object to improve in this respect a curtain wall structure comprising a metal frame provided with a compensation bar for bearing on or hanging from a projecting element fastened to the building skeleton, each metal frame also comprising members for taking over the forces due to the wind.

For this purpose in an improved curtain wall structure according to the invention, said projecting element is provided with resilient means on which said compensation bar bears. In an advantageous embodiment, said resilient means are comprised of a resilient-material block on which said compensation bar bears with a heel-shaped part.

Preferably said resilient-material block has at the bottom thereof at least one recess along the lengthwise direction and at least one recess in the cross-wise direction.

A feature of the invention lies in the members for taking over the wind-caused forces comprising shock-absorbers allowing the metal frame to move in the direction of the building skeleton or to move away therefrom, and to perform a translation movement relative to said skeleton.

Other details and features of the invention will stand out from the description given below by way of non limitative example and with reference to the accompanying drawings, in which.

Figure 1:
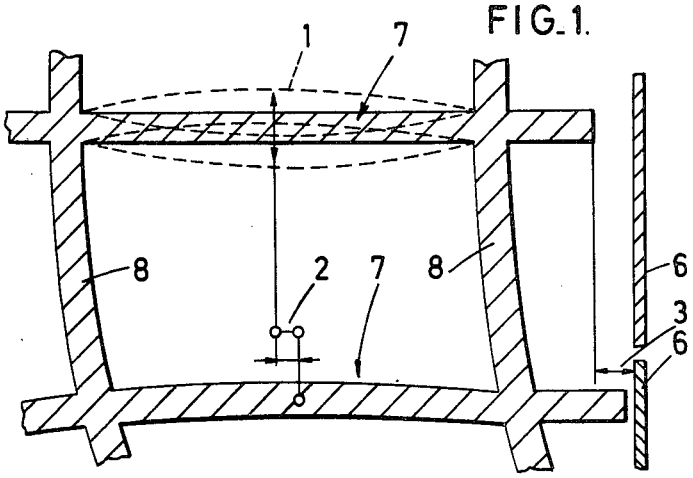
FIG. 1 is a vertical section view through one level and some elements pertaining to the curtain wall structure; this figure shows diagrammatically those motion components to be absorbed and dampened; the distortions have been shown greatly exaggerated.

The improvements as shown in the drawings comprise an ideal solution to the problems caused by the fastening and hanging of very large-sized elements relative to a building skeleton the levels or columns of which can undergo large short-time distortions due to vertical vibrations in the levels, horizontal vibrations in the frontage plane and finally horizontal vibrations at right angle to the frontage plane.

The amplitude of the vertical motions to be damped corresponds to the sum of those amplitudes transferred by the columns and the amplitudes due to the level bending between the columns. The amplitude of the horizontal motions corresponds to the combination of those amplitudes due to the ground movements and to the structure resonance swinging.

In FIG. 1, the dotted curved lines as shown in 1, show even if in an exaggerated way, the magnitude of the vertical vibrations in one level. In 2 has been shown the magnitude of the horizontal vibrations in the frontage plane while the magnitude of the horizontal vibrations at right angle to the frontage plane is shown in 3.

Said magnitudes are of course strongly exaggerated and have only for purpose to better define the bases of the problem which the invention obviates.

Figure 2:
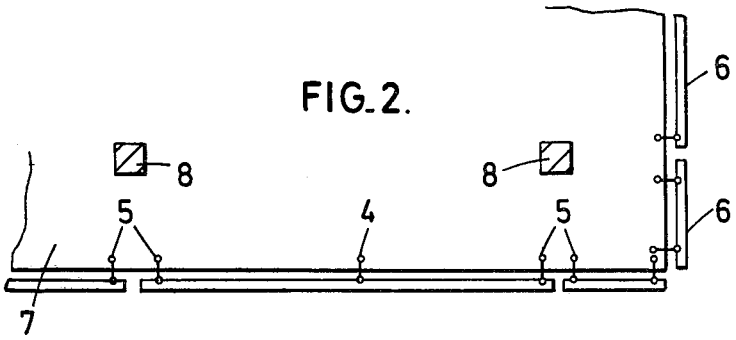
FIG. 2 shows in a diagrammatic plan view the arrangement of the curtain wall elements relative to a bearing level; the fastenings have also been shown diagrammatically.

In FIG. 2 has been shown diagrammatically the location of the hanging fastenings and of the members for taking over the wind-caused forces. In 4 is shown the position of the hanging element for hanging the glazed frame, while reference numeral 5 shows the locating of the members for taking over the wind-caused forces. The frontage elements are shown diagrammatically in FIGS. 1 and 2 in 6, the levels in 7 and the columns in 8. The structure according to the invention makes use for closing the space remaining between the metal frames comprising the frontage elements, of sealing elements with a V- or W-shaped section.

The sealing elements or gaskets have a very high resiliency not only due to the material they are made of but also to the particular shape thereof. Said shape is similar to a concertina shape.

To make as well as possible a curtain wall structure the frontage elements or frames of which can move quite substantially relative to one another or move in turn relative to the building skeleton under the action of the phenomenons mentioned above, use is made of hanging elements and members for taking over the wind-caused forces which have very peculiar resiliency properties.

Figure 3:
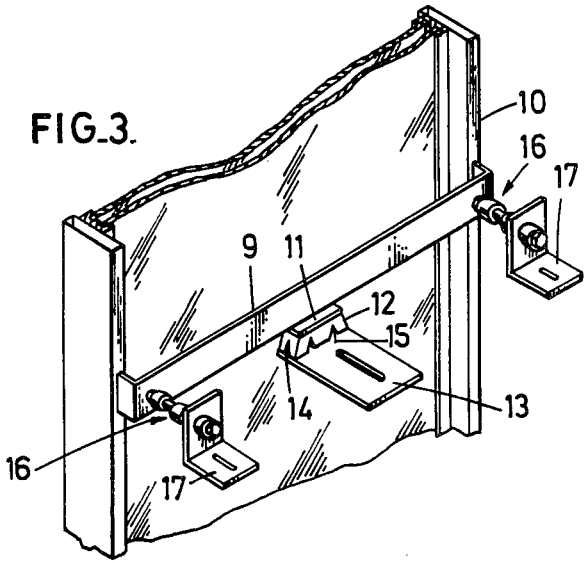
FIG. 3 is a diagrammatic perspective view of the essential elements for hanging the metal frames relative to a bearing level.

In FIG. 3, the building skeleton not being shown, there is noticed the compensation bar 9 which is part of the frame 10. Said compensation bar bears with a heel 11 which is soldered thereto, on a resilient-material block 12 which bears in turn on a plate 13 which is to be joined in a way known per se, to the building skeleton. The resilient-material block 12 is preferably provided in that surface thereof facing plate 13, with a lengthwise slit 14 and one or two cross-wise slits 15.

The frontage element is further retained by members for taking over the wind-caused forces which are shown generally in 16. Said elements are designed according to the invention, in a very peculiar way to allow substantial movements of the frames 10 relative to the frontage. Said elements are fastened to the building skeleton through angle-irons 17 (FIGS. 3 and 4).

Figure 4:
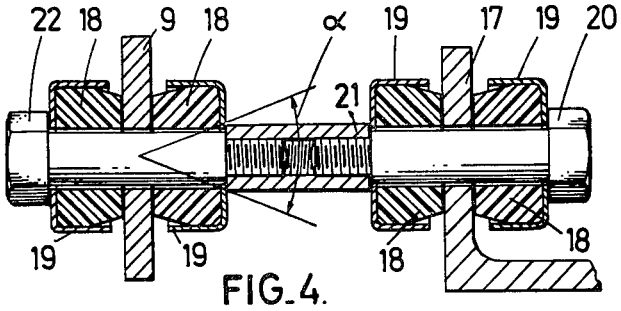
FIG. 4 is a lengthwise section view on a larger scale, of a member for taking over the wind-caused forces.

To make such substantial movements possible either in the direction of the building skeleton or in the opposite direction, or else in parallel or substantially parallel relationship thereto, said members for taking over the wind-caused forces have been designed in a very particular way which has been shown in detail in FIG. 4.

In FIG. 4, the fastening 17 has been shown in the shape of an angle-iron retained captive between two absorber pads 18 which are retained inside cups 19. All of said elements are threaded on a bolt 20 which is screwed into a cylinder 21 which receives at the opposite end, a bolt 22 which has the same function as the bolt 20. The absorber pads 18 clamped in the cups 19 retain captive by means of bolt 22, the compensation bar 9 of frame 10.

The magnitude of the movements which can be performed by the members for taking over the wind-caused forces according to the invention is dependent on the nature of the resilient material which comprises the absorber pads 18 and also on the clamping rate exerted by bolts 20 and 22. However, a magnitude range for admissible movements is given by angle $\alpha$ as shown in FIG. 4.

Those movements which are made possible by the hanging and fastening means according to the invention are very large in such a way that substantial swingings or vibrations of the building skeleton will not cause damages either in the glazing or in the metal frame of said elements, nor moveover to the fastening means thereof.

Figure 5:
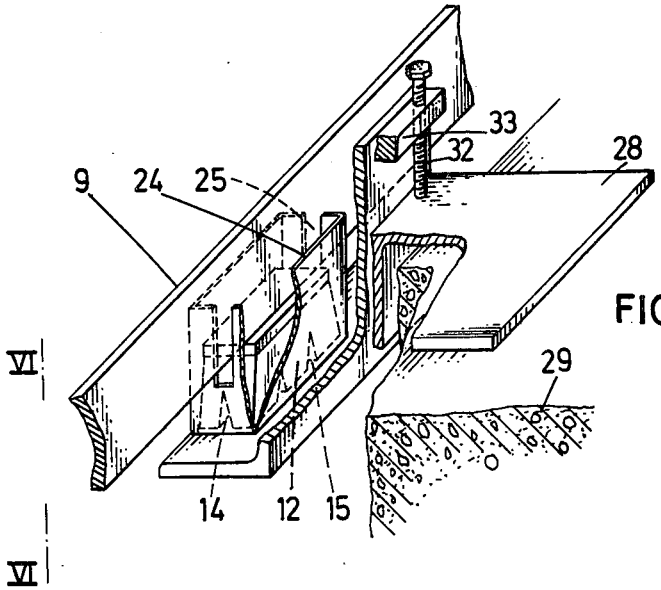
FIG. 5 is a perspective view with parts broken away, of the essential elements regarding the bearing of the compensation bar on a resilient material element.
Figure 6:
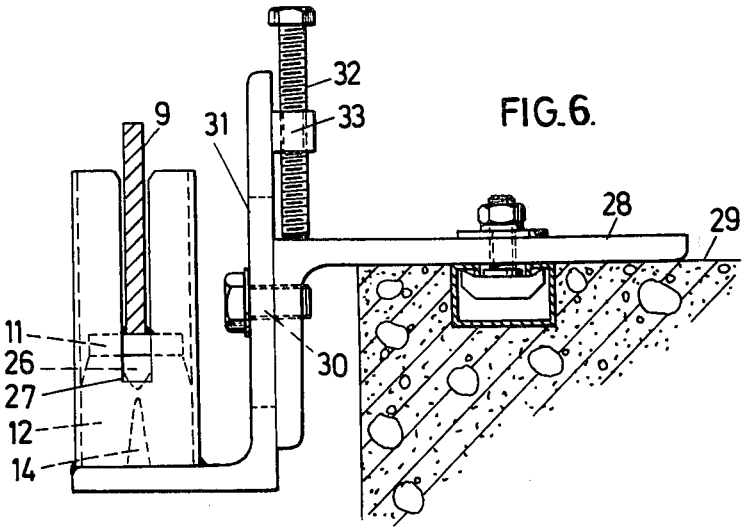
FIG. 6 is a section view along line VI—VI in FIG. 5.

FIG. 5 shows some details regarding the hanging means according to the invention. Said figure shows the bearing element 23 which is L-shaped in cross-section. To the horizontal portion of element 23 is soldered a housing 24 which is to be considered as a safety housing inside which is arranged the resilient-material block 12. The compensation bar 9 bears on the top side of said block 12 through a heel 11 while the side surfaces of housing 24 have cut-outs 25 in which enter the bar. The compensation bar heel 11 is provided with a centering boss 26 which enters a corresponding opening 27 provided in the top portion of block 12.

The vertical portion of element 23 is clamped on the fastening element 28 to the main structure of bearing level 29 by means of one or a plurality of bolts 30 going through a vertical slit 31 provided in the vertical portion of element 23. A jack 32 passing through part 33 soldered to the vertical portion of element 23 allows to adjust accurately element 23 relative to fastening element 28.

It is clear from the above description that in the curtain wall structure according to the invention, large-size frontage elements joined together by known sealing gaskets fulfill completely the requirements originating from all of the problems which are encountered when a building skeleton is subjected to substantial swingings or vibrations, as well as when it is desired to protect the glazing and the frames thereof when subjected to explosions or distortions whatever the nature of such occurences.

It must be understood that the invention is in no way limited to the above embodiments and that many changes can be brought therein without departing from the scope of the invention as defined by the appended claims.

I claim:

1. Curtain wall structure comprising a metal frame provided with a compensation bar for bearing on or hanging from a projecting element fastened to the building skeleton, each metal frame also comprising members for taking over the forces due to the wind, in which said projecting element is provided with resilient means on which said compensation bar bears, in which said resilient-material block is arranged inside a housing open at the top and soldered with the bottom thereof to said element while being provided with two side cut-outs in the compensation bar plane.

2. Curtain wall structure as defined in claim 1, in which said resilient-material block is provided at the top thereof with an opening for receiving a centering boss provided on the bottom of said heel arranged on the compensation bar.

3. Curtain wall structure as defined in claim 1, in which the members for taking over the wind-caused forces comprise shock-absorbers allowing the metal frame to move in the direction of the building skeleton or to move away therefrom, and to perform a translation movement relative to said skeleton.

4. Curtain wall structure as defined in claim 3, in which said members are comprised of a cylinder and means for clamping on the ends thereof absorber pads which can grip at the one cylinder end, an element pertaining to the metal frame and at the other cylinder end, a fastener which is made fast to the building structure.

5. Curtain wall structure as defined in clam 4, in which said absorber pads are retained by screws between cup-shaped stops.

6. Curtain wall structure comprising a metal frame provided with a compensation bar for bearing on or hanging from a projecting element fastened to the building skeleton, each metal frame also comprising members for taking over the forces due to the wind, in which said projecting element is provided with resilient means on which said compensation bar bears, in which said projecting element is comprised of two parts the first one of which is to be made fast to the building skeleton, while the second part mating therewith is vertically movable relative to said first part, an adjusting jack being provided to adjust the position of both parts relative to one another.

* * * * *